US005425333A

United States Patent [19]

Baylor et al.

[11] Patent Number: 5,425,333

[45] Date of Patent: Jun. 20, 1995

[54] ASPIRATION CONTROLLED COOLANT TRANSFER APPARATUS AND METHOD, FOR ENGINE/RADIATOR COOLING SYSTEMS

[75] Inventors: James L. Baylor, Fontana; Russell A Lindquist, Covina; Michael J. Camacho, San Dimas, all of Calif.; Rubert B. Sweeney; Michael N. Sweeney, both of Grapevine, Tex.

[73] Assignee: Wynn Oil Company, Azusa, Calif.

[21] Appl. No.: 195,097

[22] Filed: Feb. 14, 1994

[51] Int. Cl.[6] ..... F01P 11/02

[52] U.S. Cl. ..... 123/41.14; 134/169 A; 165/95; 417/149

[58] Field of Search ..... 123/41.01, 41.14; 134/169 A; 165/1, 95; 137/205; 417/148, 149, 185

[56] References Cited

U.S. PATENT DOCUMENTS

| | | | |
|---|---|---|---|
| 1,030,931 | 7/1912 | Silver . | |
| 1,451,157 | 4/1923 | Gerbig . | |
| 1,582,300 | 4/1926 | Otis . | |
| 1,701,824 | 2/1929 | Robinson . | |
| 1,742,281 | 1/1930 | Rundlett . | |
| 1,871,340 | 8/1932 | Pielstick . | |
| 2,141,427 | 12/1938 | Bryant | 417/185 |
| 2,187,413 | 1/1940 | Boezi et al. . | |
| 2,188,245 | 1/1940 | Middleton . | |
| 2,201,774 | 5/1940 | Hofele . | |
| 2,281,695 | 5/1942 | James et al. . | |
| 2,366,073 | 12/1944 | Vallerie . | |
| 2,632,719 | 3/1953 | Tankersley . | |
| 2,644,440 | 7/1953 | Bailey, Sr. . | |
| 2,888,913 | 6/1959 | Emmett et al. . | |
| 3,002,909 | 10/1961 | Heidt . | |
| 3,094,131 | 6/1963 | Williams . | |
| 3,106,194 | 10/1963 | Cantwell, Jr. et al. . | |
| 3,115,145 | 12/1963 | Monteath, Jr. . | |
| 3,148,670 | 9/1964 | Fiedler et al. . | |
| 3,173,408 | 3/1965 | Brenneman . | |
| 3,180,759 | 4/1965 | Falk . | |
| 3,211,377 | 10/1965 | Brenner . | |
| 3,224,684 | 12/1965 | Roosa . | |
| 3,318,096 | 5/1967 | Webb . | |
| 3,338,564 | 8/1967 | Roeder . | |
| 3,403,695 | 10/1968 | Hopkins . | |
| 3,409,218 | 11/1968 | Moyer . | |
| 3,540,528 | 11/1970 | Moon . | |
| 3,540,588 | 11/1970 | Estabrook . | |
| 3,589,388 | 6/1971 | Hameline, Jr. . | |
| 3,752,398 | 8/1973 | Svensson . | |
| 3,776,384 | 12/1973 | Offer . | |

(List continued on next page.)

FOREIGN PATENT DOCUMENTS

| | | |
|---|---|---|
| 1028634 | 11/1950 | France . |
| 1046597 | 5/1961 | France . |
| 1362962 | 4/1964 | France . |
| 2086488 | 5/1982 | United Kingdom . |

*Primary Examiner*—Noah P. Kamen
*Attorney, Agent, or Firm*—William W. Haefliger

[57] ABSTRACT

In apparatus for control of liquid coolant flow to and from an engine and radiator coolant system, comprising a closed tank to receive the coolant; a first line extending at the exterior of the tank, and also communicating with the tank interior, the first line connectible with the coolant system; ducting associated with the tank and having an inlet for connection to a source of compressed air, an outlet outside the tank, and having an aspiration side port between the inlet and outlet, the side port also connected to the tank interior; and a first valve for controlling compressed air flow through the ducting; whereby in one position of the valve compressed air flows into the tank via the side port to drive coolant from the tank interior via the first line and to the coolant system, and in another position of the valve compressed air flow through the ducting to the outlet acts to draw fluid into the tank from the engine coolant system via the first line, in response to suction communication to the tank interior via the side port.

9 Claims, 2 Drawing Sheets

U.S. PATENT DOCUMENTS 3,954,611 5/1976 Reedy .
3,960,208 6/1976 Anthony et al. .
3,961,482 6/1976 Jamaux .
4,015,613 4/1977 Papworth .
4,029,115 6/1977 Wheeler .
4,052,308 10/1977 Higgs .
4,054,150 10/1977 Thomas .
4,059,123 11/1977 Bartos et al. .
4,061,504 12/1977 Zall et al. .
4,082,565 4/1978 Sjolander .
4,083,399 4/1978 Babish et al. .
4,086,930 5/1978 Hiss .
4,109,703 8/1978 Babish et al. .
4,127,160 11/1978 Joffe .
4,128,140 12/1978 Riches .
4,161,160 7/1979 Hicks et al. .
4,161,979 7/1979 Stearns .
4,167,193 9/1979 Magnus et al. .
4,176,708 12/1979 Joffe .
4,190,346 2/1980 Hutson et al. .
4,197,140 4/1980 Swan .
4,209,063 6/1980 Babish et al. .
4,276,914 7/1981 Albertson .
4,290,392 9/1981 Dissmore .
4,290,446 9/1981 Seiler ..... 417/185
4,293,031 10/1981 Babish et al. .
4,331,121 5/1982 Stokes .
4,338,959 7/1982 Krueger et al. .
4,343,353 8/1982 Tsopelas .
4,346,689 8/1982 Neely .
4,366,069 12/1982 Dudrey et al. .
4,390,049 6/1983 Albertson .
4,516,547 5/1985 Williams .
4,520,773 6/1985 Koslow .
4,553,587 11/1985 Traylor .
4,597,416 7/1986 Scales .
4,606,311 8/1986 Reyes et al. .
4,606,363 8/1986 Scales .
4,671,230 6/1987 Turnipseed .
4,784,170 11/1988 Romanelli et al. .
4,787,348 11/1988 Taylor .
4,790,882 12/1988 Barres .
4,791,890 12/1988 Miles et al. .
4,793,403 12/1988 Vataru et al. .
4,809,769 3/1989 Vataru et al. .
4,877,043 10/1989 Carmichael et al. .
4,899,807 2/1990 Vataru et al. .
4,901,786 2/1990 Vataru et al. .
4,949,682 8/1990 Klein .
4,989,561 2/1991 Hein et al. .
5,015,301 5/1991 Baylor et al. .
5,021,152 6/1991 Filowitz et al. .
5,078,866 1/1992 Filowitz et al. .
5,097,806 3/1992 Vataru et al. .
5,242,273 9/1993 Payne ..... 165/95

ASPIRATION CONTROLLED COOLANT TRANSFER APPARATUS AND METHOD, FOR ENGINE/RADIATOR COOLING SYSTEMS

BACKGROUND OF THE INVENTION

This invention relates generally to flushing of internal combustion engine liquid cooling systems; more particularly, it concerns apparatus and method for conveniently and quickly relieving pressure in an engine liquid coolant system, and for transferring coolant to and from the system.

There is need for simple, efficient operation to quickly and conveniently relieve pressure in an engine liquid coolant system, and to transfer coolant to and from the system, without injury to the operator, by high temperature coolant and/or exposure to high temperature, potentially toxic coolant vapors.

SUMMARY OF THE INVENTION

It is a major object of the invention to provide simple, efficient apparatus and operational method steps meeting the above need. In its apparatus aspects, the invention embodies:

a) a closed tank to receive the coolant, b) a first line extending at the exterior of the tank, and also communicating with the tank interior, the first line connectible with the coolant system, c) ducting associated with the tank and having an inlet for connection to a source of compressed air, an outlet outside the tank, and having an aspiration side port between the inlet and outlet, the side port also connected to the tank interior, d) and a valve for controlling compressed air flow through said ducting, e) whereby in one position of the valve compressed air flows into the tank via the side port to drive coolant from the tank interior via the first line and to the coolant system, or storage receptacle, and in another position of the valve compressed air flow through the ducting to the outlet acts to draw fluid into the tank from the engine coolant system via the first line.

As will appear, the tank may typically have a cap, and the ducting and valve are carried by the cap. Also, the ducting may advantageously form a handle for carrying the tank. The ducting adjacent the side port may have venturi shape.

Another object includes connecting the line with an engine and radiator coolant system overflow tank for drawing liquid from that overflow tank into the apparatus closed tank, in the other position of the valve. Alternatively, the line may be connected with an overflow outlet associated with the radiator to draw pressurized vapor and/or liquid from the system into the apparatus closed tank, in the other position of the valve.

Another object includes connecting the venturi to the closed tank interior via an auxiliary duct extending downwardly in the tank toward coolant therein, and having a terminus above the coolant, whereby when the coolant level in the tank rises to the terminus, suction communication from the venturi to the first line via the tank interior is interrupted. A check valve in that auxiliary duct blocks flow of coolant in the tank to the venturi.

The basic method of the invention includes the steps:

a) providing a closed tank to receive the coolant, b) providing a first line extending at the exterior of the tank, and also communicating with the tank interior, the first line connectible with the coolant system, c) providing ducting in association with the tank, and to have an inlet for connection to a source of compressed air, an outlet outside the tank, and having a venturi between the inlet and outlet, the venturi also connected to the tank interior, d) providing a valve for opening and closing the outlet, e) closing the valve to allow compressed air to flow into the tank via the venturi to drive coolant from the tank interior via the line and to the coolant system, or other storage receptacle.

Another step of the method may include opening the valve to allow compressed air to flow through the venturi to the outlet, acting to draw fluid into the tank from the engine coolant system via the first line.

Yet another object includes communicating the first line with the interior of an engine and radiator coolant system overflow tank for drawing liquid from the overflow tank into the closed tank in the open condition of the valve. The line may be connected with an overflow outlet associated with the radiator for drawing liquid and/or pressurized vapors from the system into the closed tank in the open condition of the valve.

As referred to, the venturi is typically connected to the tank interior via an auxiliary duct extending downwardly into the tank interior and toward coolant therein, and having a terminus above the coolant, and the method includes allowing the coolant level in the tank to rise to the terminus, whereby suction communication from the venturi to the line via the tank interior is then interrupted.

These and other objects and advantages of the invention, as well as the details of an illustrative embodiment, will be more fully understood from the following specification and drawings, in which:

DRAWING DESCRIPTION

DETAILED DESCRIPTION

Figure 1:
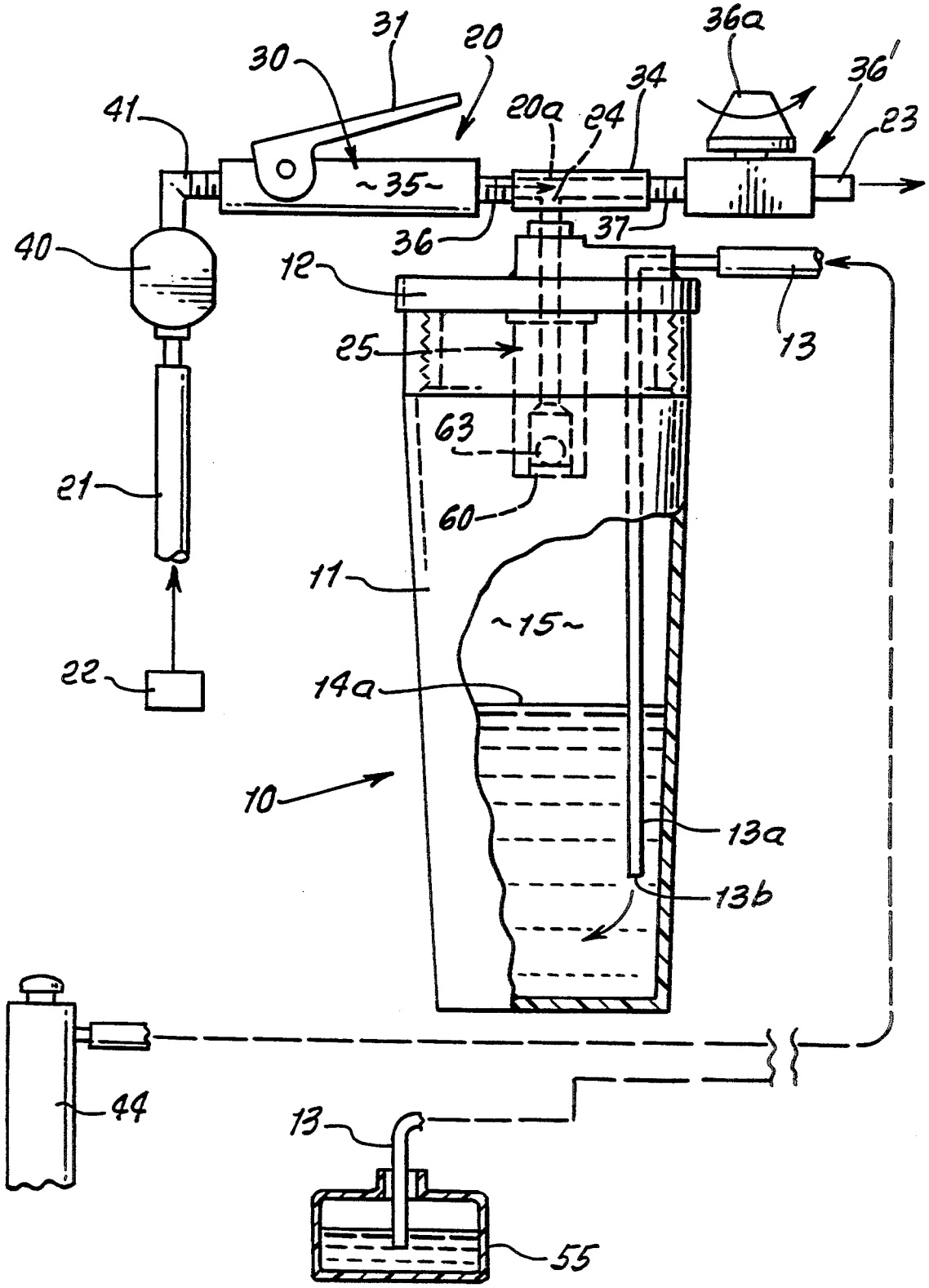
FIG. 1 is an elevation, partly in section, to show apparatus details of one form of the invention in one mode of operation.

In FIG. 1, a closed tank 10 includes an upright receptacle 11 and a cap 12, which may have threaded engagement with the upper end of the receptacle. A first line 13 extends at the receptacle exterior for connection or communication with a vehicle coolant system, as for example a radiator 44 or radiator overflow tank 55. Line 13 extends downwardly into the receptacle at 13*a*, as via the cap 12. Line 13*a* typically extends close to the bottom of the receptacle to receive fluid coolant therein, at a low level, and forced into the line lower end 13*b*, by gas pressure in the receptacle interior 15, and above the top level 14*a* of coolant therein.

Ducting 20 is also provided in association with the closed tank 10, and having an inlet 21 for connection to a source 22 of compressed air, an outlet 23 outside the tank, and an aspiration side port 24 between 21 and 23. Port 24 is connected with the tank interior 15, via an auxiliary duct 25 extending downwardly through the cap and into the upper interior of the receptacle. The ducting passage adjacent the side port, i.e., at 20*a*, may have venturi shape, to create low pressure communication to the auxiliary duct via the side port.

A manually-controlled valve 30 is connected in series with the ducting 20 for controlling compressed air flow through the ducting. See handle 31, which may be depressed to progressively open the valve and pass compressed air to outlet 23, via passage 20*a*, for creating the aspiration or suction pressure communicated to the receptacle interior. The venturi block 34, threaded tubular connector elements 36 and 37, and valve body 35 provide a handle, spaced above the cap, enabling ready carriage of the tank 10, and operation of the valve. A valve 36' is attached to threaded connector 37, i.e., between 37 and duct outlet 23, and has a manual control 36*a* enabling opening and closing of duct 20, as will be referred to below. A pressure regulator 40 is connected in series with ducting 20, i.e., between connector element 41 and the air supply.

Figure 2:
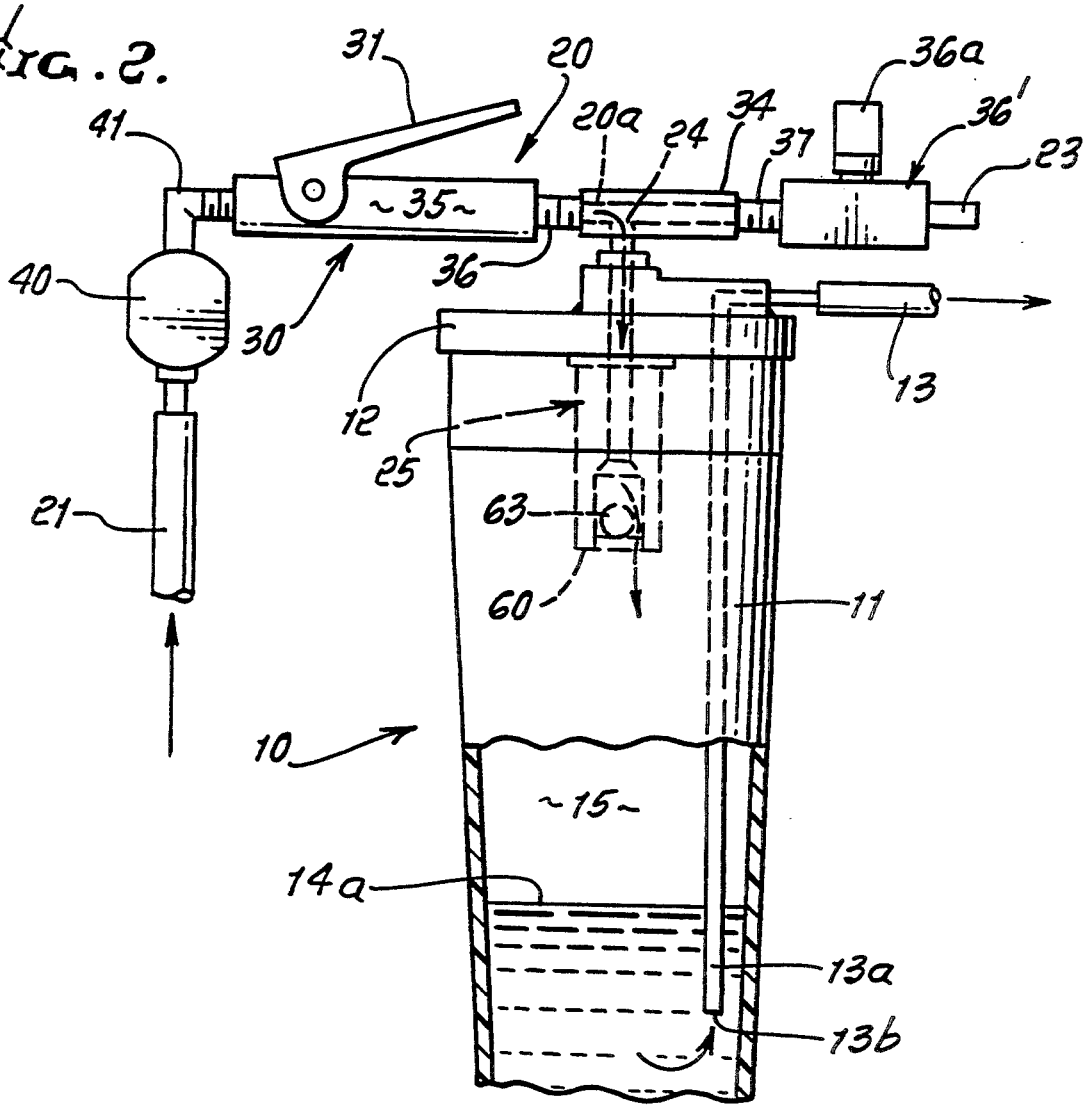
FIG. 2 is a view like FIG. 1 showing another mode of operation of the apparatus.
Figure 3:
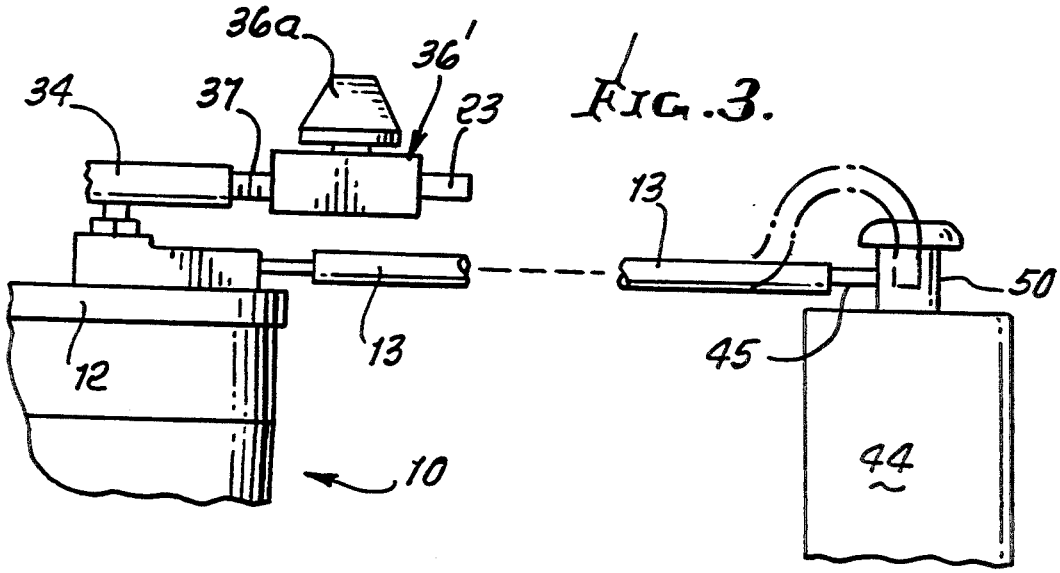
FIG. 3 is a schematic elevation showing the apparatus in FIG. 2 mode of operation, operatively connected with a coolant system radiator.

Accordingly, in one position of the manual control 36*a*, as in FIG. 2, the outlet 23 is closed off; and when handle 31 is depressed, compressed air flows into the tank via the side port and duct 25, to drive coolant from the tank interior via line 13 and to the coolant system. See FIG. 3 wherein coolant may be delivered to the radiator 44, via side inlet 45 after removal of a hose which normally connects 45 to an overflow tank, seen at 55 in FIG. 1. Thus, a measured or controllable amount of coolant, or additives, or mixture of same, may be added to the cooling system, i.e., ejected into the system. The line 13 may alternatively be extended into the radiator fill port 50, seen in FIG. 3.

In another position of the valve control 36*a*, and as seen in FIG. 1, compressed air is allowed to flow straight through the ducting 20, to and through outlet 23, whereby suction created at side port 24 acts to draw fluid or liquid into the tank interior 15 via line 13, as from the engine coolant system. FIG. 1 shows line 13 extended into the radiator overflow tank 55, so that liquid therein is transferred into the receptacle 11. Thereafter, it may be transferred, as in FIGS. 2 and 3, into the radiator, whereby the present device is well adapted to use for transferring coolant or other liquids from place to place, as required.

The auxiliary duct 25 has a lower terminus 60 spaced above the level 14*a* of coolant liquid in the receptacle. Accordingly, when the coolant top level rises to terminus 60, suction communication is to be terminated. A ball check valve 63, in the lower interior of the duct 25, closes upwardly in response to liquid level rise, to close off the upward flow of liquid in duct 25 and shut-off liquid flow into the tank, via line 13.

The method of controlling liquid coolant flow from an engine radiator coolant system includes:

a) providing a closed tank to receive the coolant and vapors, b) providing a first line extending at the exterior of the tank, and also communicating with the tank interior, the first line connectible with the coolant system, c) providing ducting in association with the tank, and to have an inlet for connection to a source of compressed air, an outlet outside the tank, and having a venturi between the inlet and outlet, the venturi also connected to the tank interior, d) providing a valve for opening and closing the outlet, e) closing the valve to allow compressed air to flow into the tank via the venturi to drive coolant from the tank interior via the line and to the coolant system.

Added steps include: opening the valve to allow compressed air to flow through the venturi to the outlet, acting to draw fluid into the tank from the engine coolant system via the first line; communicating that line with the interior of an engine and radiator coolant system overflow tank for drawing liquid from the overflow tank into the closed tank in open condition of the valve; connecting the line with an overflow outlet associated with the radiator for drawing liquid from the system into the closed tank in open condition of the valve; and allowing liquid level in the tank to control shut-off of liquid flow into the tank.

I claim:

1. In apparatus for control of liquid coolant flow to and from an engine and radiator coolant system, the combination comprising a) a closed tank to receive said coolant, b) a first line extending at the exterior of said tank, and also communicating with the tank interior, said first line connectible with the coolant system, c) ducting associated with the tank and having an inlet for connection to a source of compressed air, an outlet outside the tank, and including a passage having an aspiration side port between said inlet and outlet, the side port also connected to the tank interior, d) and a first valve for controlling compressed air flow through said ducting, e) whereby in one position of the valve compressed air flows into the tank via said passage and side port to drive coolant from the tank interior via said first line and to said coolant system, and in another position of the valve, compressed air flow through the ducting including said passage to said outlet, acts to draw fluid into the tank from the engine coolant system via said first line, in response to suction communication to the tank interior via said side port, f) said passage being employed for air flow in both said valve positions, g) there being a cap on the tank and said ducting mounted on the tank cap to form a handle for carrying the tank, and said side port located in vertical alignment with the tank interiors, h) there being an auxiliary duct in communication with said side port and extending downwardly in the tank toward coolant therein, and having a terminus above said coolant, and a one-way flow checking device associated with said auxiliary duct in the tank interior, whereby when the coolant level in the tank rises to said terminus, suction communication from said passage to said first line via the tank interior is interrupted.

2. The combination of claim 1 including an engine and radiator coolant system overflow tank into which said line extends for drawing liquid from said overflow tank into said apparatus tank, in said other position of said valve.

3. The combination of claim 1 including an overflow outlet associated with said radiator and to which said line is connected for drawing liquid and pressurized vapor from said system into said apparatus tank in said other position of said valve.

4. The combination of claim 1 wherein said flow checking device comprises a ball check valve in said auxiliary duct to block upward flow of coolant in the tank to said passage.

5. The combination of claim 1 including a second valve connected in series with said ducting to progressively control flow of compressed air through the ducting when the first valve is open.

6. The combination of claim 5 wherein said second and first valves are located in said ducting upstream and downstream, respectively, of said side port.

7. In the method of controlling liquid coolant flow to and from an engine and radiator coolant system, the steps that include:

a) providing a closed tank to receive said coolant, b) providing a first line extending at the exterior of said tank, and also communicating with the tank interior, said first line connectible with the coolant system, c) providing ducting in association with the tank, and to have an inlet for connection to a source of compressed air, an outlet outside the tank, and having a venturi between said inlet and outlet, the venturi also connected to the tank interior, d) providing a valve for opening and closing said outlet, e) closing said valve to allow compressed air to flow into the tank via said venturi to drive coolant from the tank interior via said line and to the coolant system, f) opening said valve to allow compressed air to flow through the venturi to said outlet, acting to draw fluid into the tank from the engine coolant system via said first line, g) employing said venturi for both said e) and f) steps, h) providing a cap on the tank and said ducting provided to be connected to the cap, and thereby forming a handle for carrying the tank via said cap, i) providing an auxiliary duct in communication with said venturi and extending downwardly in the tank toward coolant therein, and having a terminus above said coolant, and providing a one-way flow checking device associated with said auxiliary duct in the tank interior, whereby when the coolant level in the tank rises to said terminus, suction communication from the venturi to said first line via the tank interior is interrupted.

8. The method of claim 7 which includes communicating said line with the interior of an engine and radiator coolant system overflow tank for drawing liquid from said overflow tank into said closed tank in said open condition of the valve.

9. The method of claim 7 which includes connecting said line with an overflow outlet associated with the radiator for drawing liquid from said system into said closed tank in said open condition of the valve.

* * * * *